US007895991B2

(12) United States Patent
Lin et al.

(10) Patent No.: US 7,895,991 B2
(45) Date of Patent: Mar. 1, 2011

(54) INTEGRATED CANISTER STRAINER

(75) Inventors: Jhun Lin, Novi, MI (US); Robert D. Boyer, Livonia, MI (US); Michael G. Heim, Brownstown, MI (US); Mark Edward Hipp, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 93 days.

(21) Appl. No.: 12/463,500

(22) Filed: May 11, 2009

(65) Prior Publication Data

US 2010/0282220 A1 Nov. 11, 2010

(51) Int. Cl.
*F02M 33/04* (2006.01)
*F02M 33/02* (2006.01)

(52) U.S. Cl. ..... 123/519

(58) Field of Classification Search ..... 123/519, 123/520, 518, 516; 55/419, 476, 514, 518, 55/519

See application file for complete search history.

(56) References Cited

U.S. PATENT DOCUMENTS 3,683,597 A * 8/1972 Beveridge et al. ..... 123/519
4,437,322 A 3/1984 Ertinger
4,657,186 A 4/1987 Shapiro
5,058,693 A 10/1991 Murdock et al.
5,912,368 A 6/1999 Satarino et al.
6,237,574 B1 5/2001 Jamrog et al.
6,357,673 B1 3/2002 Condon
6,860,267 B2 3/2005 Capon et al.
7,086,383 B2 8/2006 Ivens et al.
7,250,387 B2 7/2007 Durante et al.
7,311,764 B2 12/2007 Friday et al.
7,316,726 B2 1/2008 Schwindt
2007/0056589 A1 3/2007 Capon et al.
2007/0107702 A1 5/2007 King

* cited by examiner

*Primary Examiner* — Mahmoud Gimie

(74) *Attorney, Agent, or Firm* — Julia Voutyras; Brooks Kushman P.C.

(57) ABSTRACT

A carbon canister adapted for use in an automotive vehicle is disclosed. The system has a carbon canister housing defining a cavity adapted for holding carbon pellets with the housing including: a port and a strainer disposed between the port and the cavity with a portion of a surface of the strainer being convex with respect to the cavity wherein the strainer has a plurality of orifices. The integral strainer obviates the need for a foam filter to prevent the carbon pellets from escaping from the carbon canister housing through the port. In some applications, the carbon canister system has three ports: one to the engine, one to atmosphere, and one to a vent of the fuel tank, each having a strainer disposed in the port.

20 Claims, 6 Drawing Sheets

INTEGRATED CANISTER STRAINER

BACKGROUND

1. Technical Field

The present disclosure relates to a carbon canister as part of a fuel vapor management system on an automotive vehicle.

2. Background

For many years, carbon canisters containing activated carbon pellets have been used on automotive vehicles to reduce or prevent fuel vapors from a vehicle fuel tank escaping to atmosphere. In a typical application, the vapor storage canister is coupled to the vehicle fuel tank as well as the vehicle engine with a vent valve to atmosphere. The activated carbon pellets in the canister absorb fuel vapors from the fuel tank during a storage mode, such as when the fuel tank is being filled. The stored fuel vapors are periodically purged from the carbon pellets during a purge mode by passing air from atmosphere over the pellets to desorb the fuel, with the fuel vapor inducted by the engine and combusted during engine operation. The carbon pellets are added to the canister during assembly. Typically, a permanent filter, such as a foam filter, is installed at each entry/exit port to retain the pellets and any small particles that may break off of the pellets during assembly or subsequent operation. The size of each port is determined in conjunction with the filter characteristics to maintain a desired flow rate through the filter/port while accommodating some reduction in flow rate due to anticipated filter clogging. A decreased filter/port flow rate may result in incomplete purging of the stored fuel vapors during certain, regulated driving events. It is known in the prior art to provide a filter at each entry/exit port of the carbon canister to prevent the activated carbon pellets from migrating out of the carbon canister. It is also known in the prior art to affix tubes to the carbon canister housing to provide entry/exit ports. The resulting carbon canister is assembled of many parts. It is desirable to reduce the number of parts to be assembled to reduce cost and parts complexity and to increase robustness of the carbon canister.

SUMMARY

To overcome at least one problem in the prior art, a carbon canister is disclosed in which a strainer and a tube for making connections to the carbon canister are molded integrally with the carbon canister housing. The strainer has orifices with a width less than a width of the average carbon pellet to prevent carbon pellets from exiting the carbon canister. By molding the tube and strainer integrally with the carbon canister, the need for affixing separate tube and filters is obviated. According to one embodiment of the present disclosure, the strainer extends into the carbon canister cavity in 3 dimensions to provide a large surface area with orifices so that pressure drop across the strainer is minimized.

An advantage of the present disclosure is that by integrally molding in the tube and the strainer with the carbon canister housing, the number of individual parts to assembly a carbon canister is reduced. This makes assembly simpler, less prone to assembly mistakes, and cheaper. The carbon canister is more robust by having the parts integrally molded with the carbon canister housing. Any one tube, such as the tube coupled to the fuel tank, can be integrally molded with the canister housing. Alternatively, any combination of the strainers and tubes can be integrally molded.

Yet another advantage of the present disclosure is that because the strainer extends into 3 dimensions, the surface area of the strainer is greater than it would be if the strainer surface was planar. A planar strainer configuration is able to accommodate fewer orifices than a strainer with a more convoluted surface. Because the 3-dimensional strainer has more orifices, it can accommodate more occlusion of orifices by carbon pellets without suffering such a large pressure drop across the strainer as compared to a filter or a planar strainer configuration.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
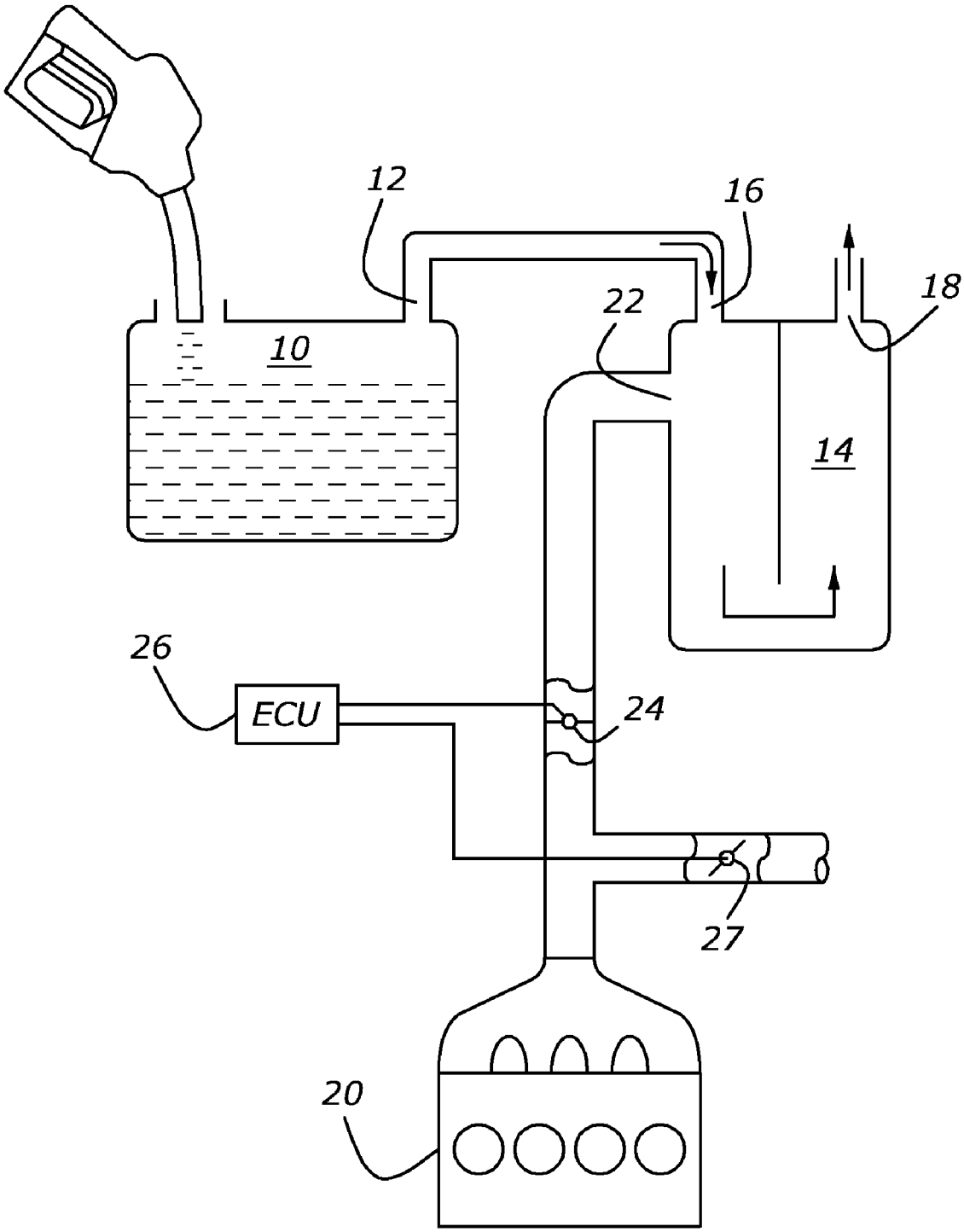
FIG. 1 is a schematic of a fuel recovery system operating in a vapor recovery mode.

When an automotive fuel tank is filled, fuel vapor laden air is displaced by fuel. To prevent those fuel vapors from entering the atmosphere, fuel tank 10 is provided with a fuel vent 12 communicating to a carbon canister 14 filled with activated carbon pellets via port 16, as shown schematically in FIG. 1. As the gases containing fuel vapor pass through the bed of carbon pellets, the fuel vapor is absorbed by the carbon pellets. Carbon canister 14 also has a port 18 communicating to the atmosphere. When such gases exit carbon canister 14, all, or substantially all, of the fuel has been stripped from the gases displaced from the fuel tank by virtue of contact with the carbon pellets. Such operation as shown in FIG. 1 is sometimes referred to as vapor recovery mode.

Figure 2:
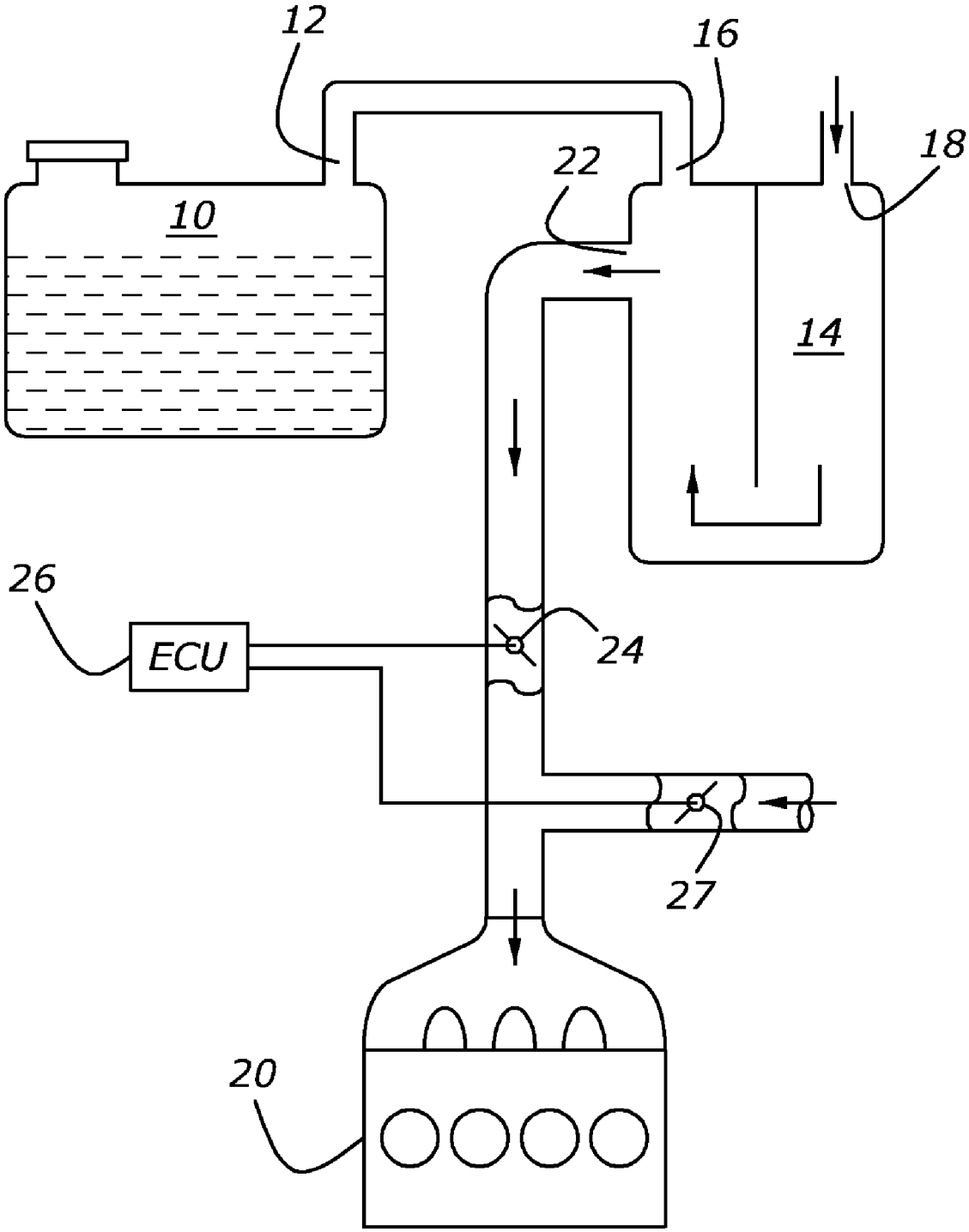
FIG. 2 is a schematic of a fuel recovery system operating in a purge mode.

The activated carbon pellets have a limited ability to store fuel and, therefore, must be purged so that they can once again absorb fuel vapor displaced from fuel tank 10. This is accomplished by pulling fresh air through the carbon pellet bed within carbon canister 14 and inducting that air, which contains desorbed fuel, through port 22 into an operating internal combustion engine 20, as shown in FIG. 2. The fuel vapors that are desorbed into the incoming air are combusted in engine 20 largely forming carbon dioxide and water before being exhausted from engine 20. A valve 24 located upstream of engine 20 is adjusted by electronic control unit 26 to control the flow of gases through carbon canister 14. The gases introduced through purge valve 24 are mixed with air entering an engine intake through throttle valve 27, which is also controlled by electronic control unit 26. Such operation as shown in FIG. 2 is sometimes referred to as purge mode.

Figure 3:
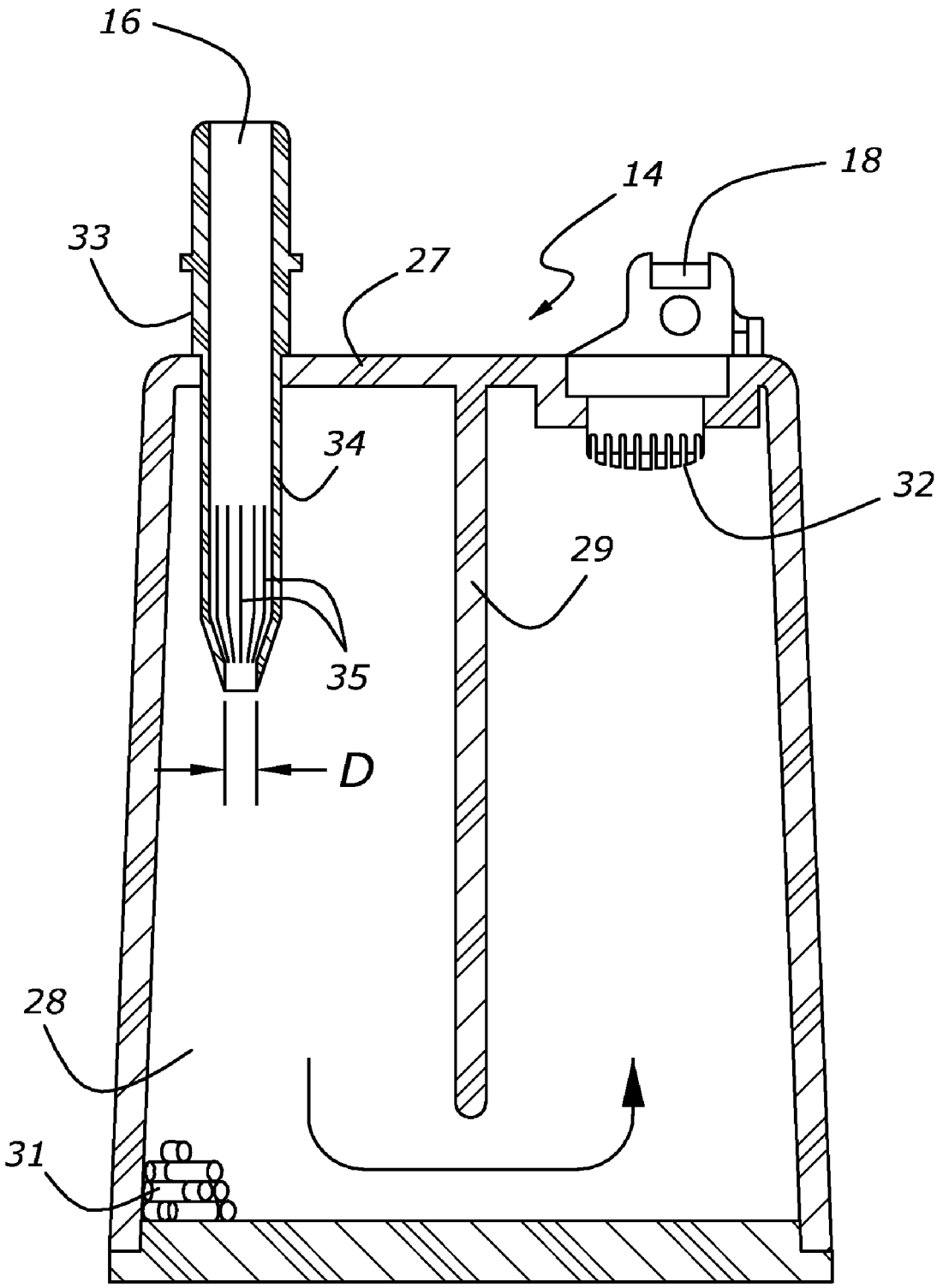
FIGS. 3 and 4 are cutaways of a carbon canister according to embodiments of the present disclosure.

In FIG. 3, a carbon canister 14 is shown having a housing 27, which defines a cavity 28 within. In use, cavity 28 is filled with activated carbon pellets. However for illustration purposes in FIG. 3, a portion of a carbon pellet bed 31 is shown in a corner of cavity 28. Carbon canister 14, as shown in FIG. 3, is a two-pass canister, with divider 29 diverting the flow so that it does not short circuit directly from port 16 to port 18. In vapor recovery mode, gases flow from the fuel tank 10 through port 12 through port 16 into cavity 28 of carbon canister 14 and exit through port 18 to atmosphere. Carbon pellets 31 provided in cavity 28 remove fuel vapors from the gases entering carbon canister 14 so that the gases exiting to the atmosphere contain substantially no fuel vapor. Between port 12 and cavity 28, a strainer 30 is provided. Strainer 30 substantially prevents carbon pellets from migrating out of cavity 28. A strainer 32 is also provided between cavity 28 and port 18. Not shown in FIG. 3 is a compression plate that is typically included at the bottom of carbon canister 14. The spring-loaded compression plate compacts the carbon pellets, which would force pellets through ports 12 and 18 if strainers 30 and 32 were not provided. In the embodiment shown in FIG. 3, port 16 is provided in a tube 33 continuing into a strainer 34, shown in cross-section. Tube 33 has a cylindrical section extending away from canister housing 27 providing a sealing surface to connect to fuel tank 10. In the embodiment shown in FIG. 3, tube 33 has a circumferential raised portion providing an annular ridge for securing a connecting tube. Strainer 34 forms a conical section at one end. There is a hole of diameter, D, in the end. There are slits 35 of width, W, formed in the conical section and continuing into the cylindrical portion of strainer 33. Tube 33 and strainer 34 are integrally molded with canister housing 27. In the prior art, tube 33 and strainer 34 were molded separately and then attached to canister housing 27. However, by using modern simulation techniques, the molding process can be optimized, without resort to trial and error, to avoid non-uniform mold temperatures and pressures during the molding process. By careful iteration on the gates, runner, and cavity layouts, features, such as 33 and 34, can be molded integrally with housing 27 without incurring excessive tool wear and within dimensional tolerance for the features.

Figure 4:
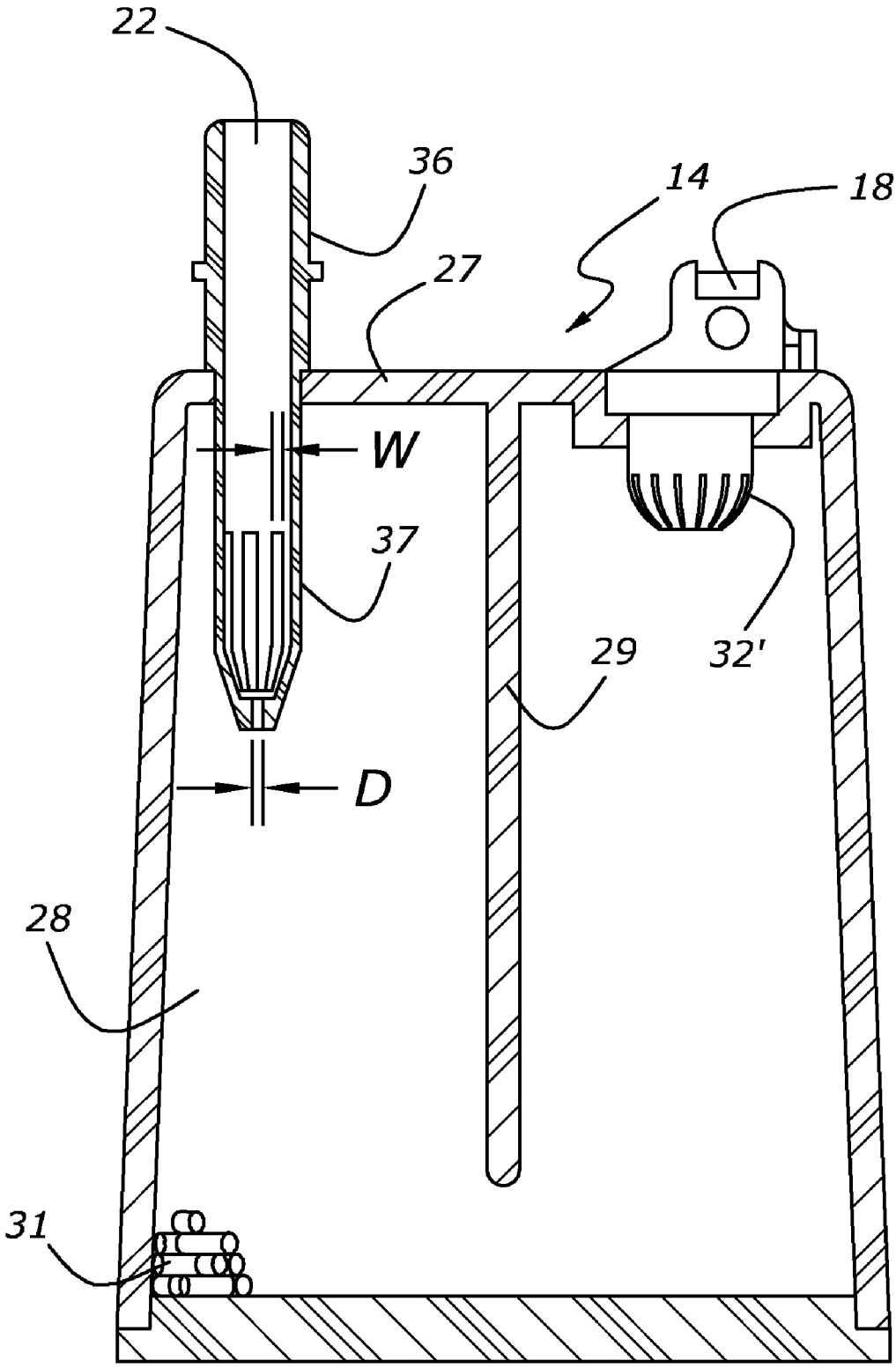

In FIG. 4, a view of carbon canister 14 is provided which shows a port 22 leading to engine 20 (not shown). When carbon canister 14 is purging, air from the atmosphere is inducted through port 18 into cavity 28 and exits port 22 to be introduced into engine 20. The flowing air strips off absorbed fuel from the carbon pellets (not shown in FIG. 3) and delivers that fuel to engine 20 where it is combusted. Port 22 is formed in tube 36 and continues through strainer 37. Strainer 37 has an orifice of diameter, D, at one end. Strainer 37 also has slits of width, W, in a conical section and continuing in the cylindrical portion. Strainer 32' is provided in between port 18 and cavity 28 to ensure that the carbon pellets remain within cavity 28.

In FIGS. 1-4, ports 16, 18, and 22 are in the top of carbon canister 14 and carbon canister 14 has a two-pass arrangement. This is a non-limiting example. Carbon canister 14 can have any number of passes. When the number of passes is an odd number, port 18 is disposed in an opposite end of carbon canister 14 from ports 16 and 22. In FIG. 3, port 16 is shown in cross-section and in FIG. 4, port 22 is shown in cross-section. In one embodiment this is due to the two ports being in line with each other and visible only by virtue the cross-sectional view being different in the two Figures.

Figure 5:
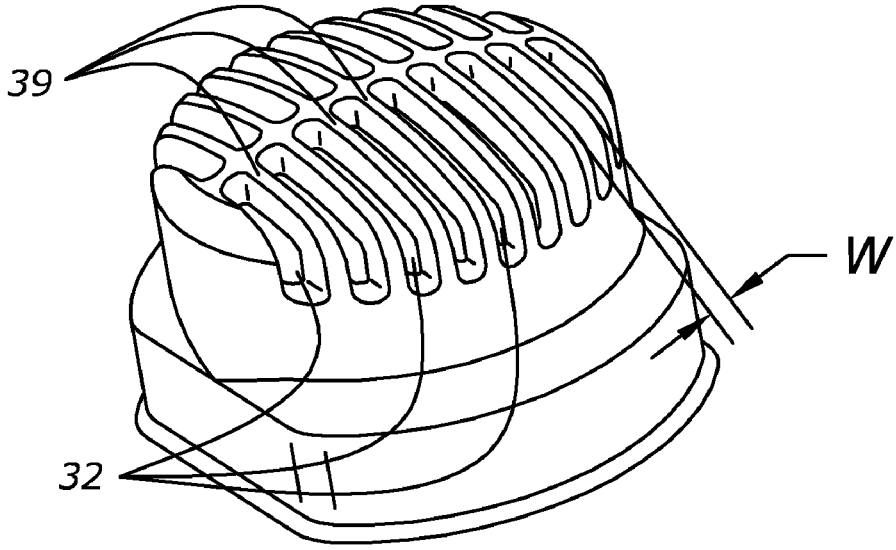
FIGS. 5 through 8 are perspective drawings of strainers according to embodiments of the present disclosure.

According to one embodiment, strainer 32 of FIG. 3 is integrally molded with housing 27. Strainer 32 extends into cavity 28. Referring to FIG. 5, strainer 32 has multiple orifices, one of which is designated 38. In a non-limiting example, the orifices are slots having a width, W. The slots are parallel along the distal surface of strainer 32. The slots extend down the cylindrical surface of strainer 32. Strainer 32 has a 3-dimensional shape with the distal end substantially being a part of a sphere connected to the cylindrical sides. The shape of the surface of strainer 32 is overall convex as viewed from cavity 28.

Figure 6:
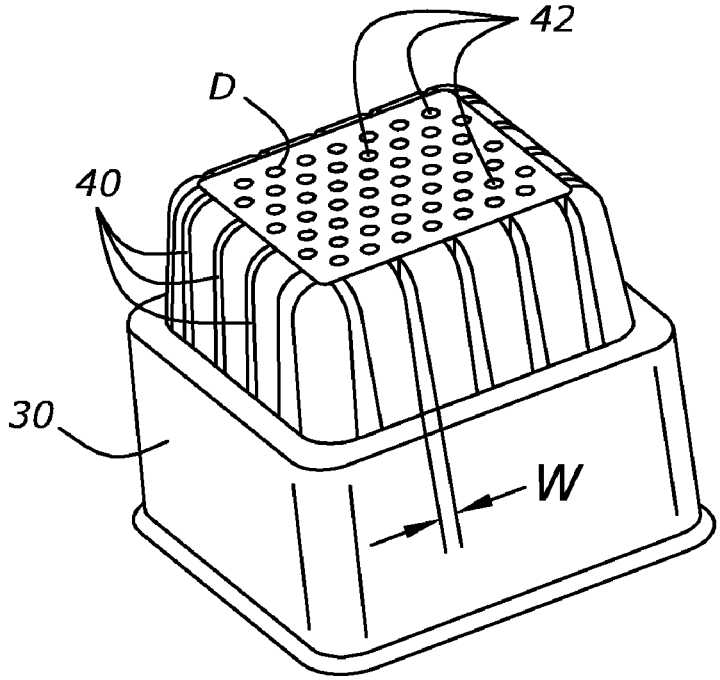

Referring to FIG. 6, strainer 39 is substantially square in cross-section having circular orifices of diameter D (one of which is designated 42) on the planar, distal end and slots having a width, W, (one of which is designated 40) along sloping sides of strainer 39.

Figure 7:
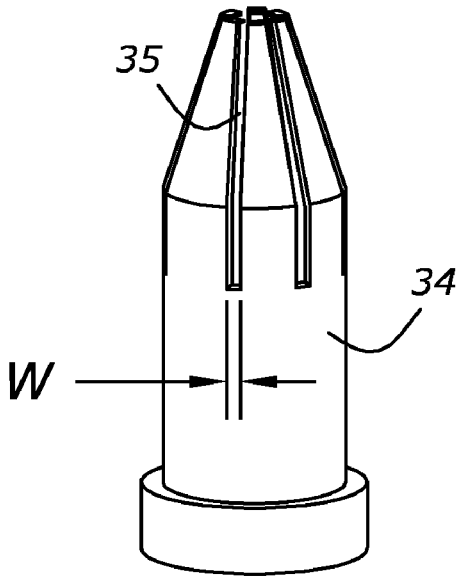
Figure 8:
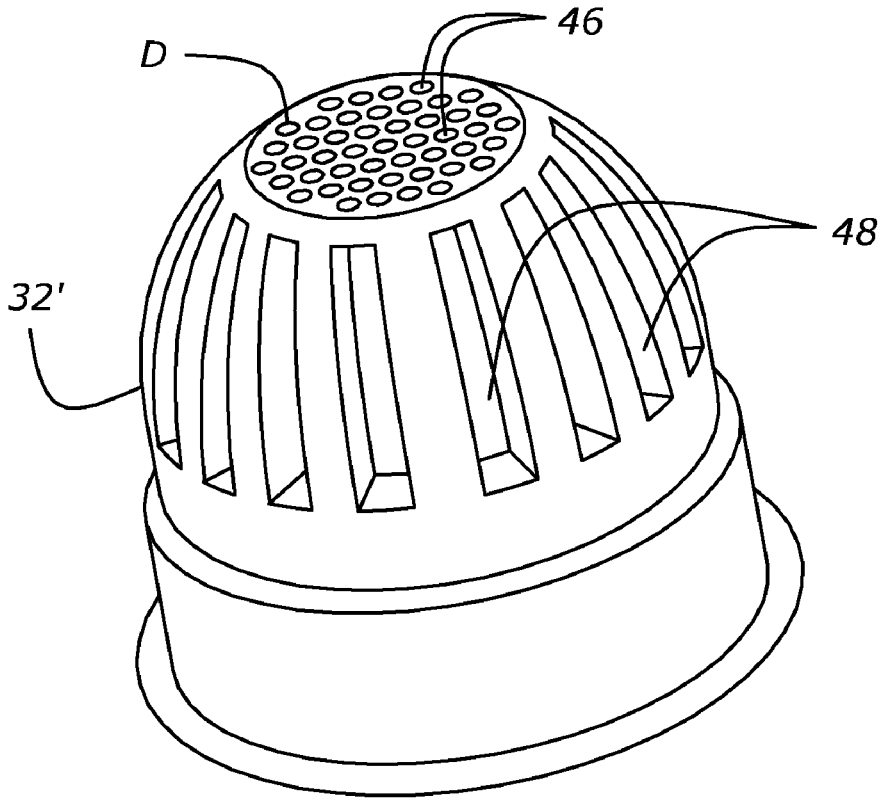

In FIG. 7, strainer 37 has a cylindrical portion with a conical tip and having slots 44 with width, W. In FIG. 8, strainer 32' is shown having both circular orifices 46 and slots 48.

Surfaces of strainers 32, 32', 34, 37, and 39 are 3-dimensional. Each of these embodiments is generally convex as viewed from cavity 28. However, these are non-limiting examples. A strainer having a surface with a concave portion as viewed from cavity 28 is a further alternative.

Figure 9:
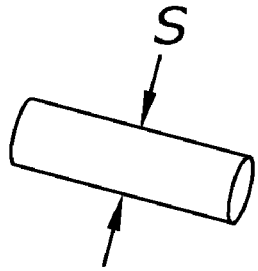
FIG. 9 is a sketch of a carbon pellet.

In FIG. 9, a typical carbon pellet is shown having a diameter of S (or span). W of the slots or D of the circular orifices are smaller than S of the pellet to prevent the pellets from migrating through the strainers. The diameters for individual pellets of a batch of carbon pellets have a distribution in size. The W and D dimensions of the orifices are selected so that substantially even the smallest pellet does not slide through the strainer's orifices.

As such, the present disclosure provides a tube for attachment and a strainer integrally molded with the carbon canister housing to obviate the need for a separate filter element or a separately attached tube, thereby reducing system complexity and cost. Because the strainer extends into 3 dimensions, the surface area is increased and can accommodate more openings to provide a desired flow rate while tolerating some blockage by pellets or particles such that purge times are not adversely impacted due to strainer blockage.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

What is claimed:

1. A carbon canister adapted for use in an automotive vehicle, comprising:

a carbon canister housing defining a cavity adapted for holding carbon pellets, the carbon canister housing including:

a tube defining a port, the tube integrally molded with the canister housing; and a strainer integrally molded with the canister housing and disposed between the port and the cavity, wherein the strainer comprises a plurality of orifices.

2. The carbon canister of claim 1 wherein the vehicle has an internal combustion engine with an intake system and the intake system is coupled to the tube.

3. The carbon canister of claim 1 wherein the vehicle has a fuel tank disposed therein, the fuel tank is coupled to the tube of the carbon canister, the tube is a fuel vent tube, and the strainer is a fuel vent strainer.

4. The carbon canister of claim 3 wherein the vehicle has an internal combustion engine with an intake system, the carbon canister further comprising:

an engine tube defining an engine port, the engine tube integrally molded with the canister housing and coupled to the engine intake system; and an intake strainer integrally molded with the canister housing and disposed between the engine port and the cavity, wherein the intake strainer comprises a plurality of orifices.

5. The carbon canister of claim 4 wherein the carbon canister defines an atmospheric port, the carbon canister further comprising:

an atmospheric strainer integrally molded with the canister housing and disposed between the atmospheric port and the cavity.

6. The carbon canister of claim 1 wherein a portion of the orifices are circular with a diameter of the orifice being less than a predetermined span.

7. The carbon canister of claim 1 wherein a portion of the orifices are slots having a width and a length with the width being less than a predetermined span.

8. The carbon canister of claim 7, further comprising:

carbon pellets disposed in the cavity wherein the carbon pellets have an average diameter and an average length and the predetermined span is less than the average diameter of the carbon pellets.

9. The carbon canister of claim 6 wherein at least one slot extends over more than one plane of the strainer surface.

10. A carbon canister housing defining a cavity adapted for holding carbon pellets, the housing including:

a tube integrally molded with the canister housing, the tube having a port to allow fluidic communication between the inside and the outside of the carbon canister; and a strainer integrally molded with the canister housing, the strainer disposed between the port and the cavity, wherein a surface of the strainer extends in 3 dimensions.

11. The carbon canister housing of claim 10 wherein the surface of the strainer comprises a plurality of non-coincident planar surfaces.

12. The carbon canister housing of claim 11 wherein the surface of the strainer has orifices allowing communication between the port and the cavity.

13. The carbon canister of housing claim 10 wherein the port provides fluidic communication between an interior of the carbon canister housing and one of atmosphere, an intake of an internal combustion engine disposed in the automotive vehicle, and a vent of a fuel tank disposed in the automotive vehicle.

14. The carbon canister of claim 10 wherein the strainer has a plurality of orifices and a width of the orifices is based on dimensions of the carbon pellets so that when fresh carbon pellets are provided in the cavity, the fresh carbon pellets are substantially prevented from exiting through the strainer.

15. A fuel vapor recovery system installed in an automotive vehicle having a fuel tank and an internal combustion engine, comprising:

a carbon canister housing;

carbon pellets contained in a cavity within the carbon canister housing, wherein the carbon canister housing comprises:

a first tube integrally molded with the canister housing, the first tube coupled to an intake of the engine;

a second tube integrally molded with the canister housing, the second tube coupled to a vent of the fuel tank;

a first strainer integrally molded with the carbon canister housing, wherein the first strainer is disposed between the carbon pellets and the first tube.

16. The fuel vapor recovery system of claim 15 wherein the first strainer has a surface with a plurality of orifices, a first orifice being in a first plane of the surface and a second orifice being in a second plane of the surface, the first plane being non-coplanar with respect to the second plane, and a cross-section of the orifices is one of: a circle, an oval, and a slit.

17. The fuel vapor recovery system of claim 15, further comprising: a second strainer disposed within the carbon canister housing and formed integrally with the carbon canister housing, the second strainer being disposed between the second tube and the vent of the fuel tank.

18. The fuel vapor recovery system of claim 15, further comprising:

an atmospheric port defined in the carbon canister housing, the port providing communication between the cavity and atmosphere; and a third strainer formed integrally with the carbon canister housing, the third strainer being disposed between the atmospheric port and atmosphere.

19. The fuel vapor recovery system of claim 16 wherein a width of the orifices is less than a predetermined span.

20. The fuel vapor recovery system of claim 19 wherein the predetermined span is based on dimensions of the carbon pellets such that the first strainer substantially prevents carbon pellets from traveling from the cavity into the intake of the engine.

* * * * *